US005636386A

United States Patent [19]

Salamone

[11] Patent Number: 5,636,386

[45] Date of Patent: Jun. 10, 1997

[54] PLEATED TENNIS SKIRT WITH POCKET AND METHOD FOR MANUFACTURING THE SAME

[75] Inventor: Frank Salamone, Easton, Pa.

[73] Assignee: Rex Sportswear, Inc., Easton, Pa.

[21] Appl. No.: 187,381

[22] Filed: Jan. 24, 1994

[51] Int. Cl.[6] ..... A41D 27/00; A41D 27/20

[52] U.S. Cl. ..... 2/247; 2/211; 2/243.1

[58] Field of Search ..... 2/48, 49, 69, 69.8, 2/105, 106, 211, 212, 213, 214, 215, 216, 217, 218, 219, 222, 223, 275, 247, 248, 249, 250, 251, 252

[56] References Cited

U.S. PATENT DOCUMENTS

| | | | |
|---|---|---|---|
| 559,919 | 3/1896 | Silverman | 2/247 |
| 2,263,546 | 11/1941 | Goldsmith et al. . | |
| 2,791,779 | 5/1957 | Presson | 2/211 |
| 2,916,741 | 12/1959 | Weiser | 2/211 |
| 3,034,135 | 11/1962 | Hebras . | |
| 3,763,500 | 10/1973 | Erischer . | |
| 5,265,778 | 11/1993 | Shehebar | 2/211 X |

FOREIGN PATENT DOCUMENTS

| | | | |
|---|---|---|---|
| 2571939 | 4/1986 | France | 2/247 |
| 33501 | 2/1908 | Germany | 2/211 |

OTHER PUBLICATIONS le coq sportif, Printemps (Catalog), p. 3, 1994, (illustrating at p. 3 the "Bernadette and Bonnie" tennis skirts).

*Primary Examiner*—Jeanette E. Chapman
*Attorney, Agent, or Firm*—Hoffmann & Baron

[57] ABSTRACT

A tennis skirt having a pocket hidden within a pleated, partially tacked down, knife edge tennis skirt is disclosed. The pocket is hidden within the upper, tacked down portion of the pleat. Due to the unique manufacturing process of the present invention, the resulting tennis skirt provides a hidden pocket which is rugged in construction and can attractively hold tennis balls, keys and other items, without detracting from the continuous cascading pleated look of the tennis skirt. In addition a step-by-step method of manufacturing a garment, specifically a tennis skirt having a tacked down knife edge pleats with a hidden pocket is also disclosed.

9 Claims, 6 Drawing Sheets

PLEATED TENNIS SKIRT WITH POCKET AND METHOD FOR MANUFACTURING THE SAME

BACKGROUND OF THE INVENTION

1. Field of the Invention

The present invention relates to a pleated tennis skirt with a pocket hidden within the upper portion of the pleat, and a method for manufacturing such a skirt.

2. Background of the Related Art

The classic pleated tennis skirt is a mainstay of woman's tennis. It is a comfortable, attractive and lightweight. However, none of the existing pleated tennis skirts includes a pocket, since it is very difficult to attach a pocket and still maintain a continuous flowing look that is so popular in current tennis fashion. The LeCoq Sportif "Bonnie" skirt is a classic knife pleated tennis skirt, in which the pleats completely wrap-around the circumference of the skirt. The top portion of the pleats are "tacked", i.e. sewn down at the top approximately ⅓ the height of the skirt, while the bottom portions of the pleats are pressed into a form fitting, knife edge cascade. This design results in an attractive looking tennis skirt which is forgiving, if the wearer experiences weight gain or weight loss, while attractively complementing the player's figure. None of the "Bonnie" knife edge pleated skirts nor any other tennis skirts that have a tacked down, cascading pleated knife edge design that include pockets for holding keys, tennis balls and the like.

Another type of tennis skirt is the LeCoq Sportif "Bernadette" skirt, which has inverted box pleats facing each other. In this skirt, a pocket has been placed within the upper sewn together portion of the inverted box pleats. This design, however, is not a wrap-around knife pleated skirt and does not have the cascading appearance or the forgiving nature of, for example "Bonnie" knife edge pleated tennis skirt. In addition, the placement of a pocket at the portions where the facing inverted box pleats meet, and are sewn together is not very difficult. The invented box pleats meet to form an open space beneath them, and a continuous flat surface is formed where the pleats are sewn together. The seams merely have to be opened, allowing the pocket to be placed within the opened slit. Unfortunately, the "Bernadette" skirt does not have the same cascading appearance and forgiving function as the "Bonnie" skirt.

Unlike tennis skirts, pleated dress skirts have been manufactured with pockets, however, in such dress skirts the pleats are not pressed as a knife edge and are not tacked down at the top. One such pleated dress skirt is made from silk and is sold by Saks Fifth Avenue under the name "THE WORKS". In this skirt, the pleats are loose and flowing, and the upper portion of the pleats are open. These pleats are not tacked down and continue loose up to the very upper portion at the waistband. The appearance and function of such a skirt is quite different from the tennis skirts described above. Since the pleats are not tacked down, the manner in which the pocket is attached beneath one of the pleats is not critical. The dress skirt does not require the strength and resiliency, especially at a pocket, that is necessary in sportswear, such as in tennis skirts. Accordingly, the opening for the pocket is not reinforced, and is small. Since the pleats of the dress skirt are not tacked down, it is also not as difficult to hide the pocket opening.

A pleated trouser including a pocket which is covered and normally concealed from view by the pleats is described in U.S. Pat. No. 2,263,546 to Goldsmith et al. The trouser include right and left panels connected at the crotch. Each panel includes a two vertically extending first pleats formed in continuation of the front crease, and two parallel but relatively shorter second pleats spaced apart from each of the respective first pleats. The trousers have pockets provided at the front of the garment having the openings of the pockets concealed under each of the second pleats. That structure of a pleated tennis skirt is not disclosed.

A pattern for forming a pleated garment, including a plurality of folds for accommodating a zipper is described in U.S. Pat. No. 3,763,500 to Erischer. A top portion for the zipper includes a reverse fold and a bottom, under-zipper portion includes a forward fold, at the respective edges. The pattern produces a garment with a continuous pleated pattern and one pleat which conceals the zipper from view. A pleated tennis skirt is not disclosed.

A method for manufacturing pleated skirts is described in U.S. Pat. No. 3,034,235 to Hebras. This patent is provided as general background information disclosing a method for attaching a waistband to a pleated skirt. This patent does not disclose tacked down pleats, nor does it describe the placement of pockets within the pleats.

In summary, the related art patents and skirts only generally provide the placement of a pocket within a pleat of a garment. However, none of the related art provides a wrap-around knife edge tennis skirt having a pocket hidden by the upper sewn down portion of the pleats. In addition, none of the related art provides a step-by-step method of manufacturing a pleated garment, and specifically a pleated tennis skirt containing a pocket hidden by an upper, tacked down portion of a pleat.

Accordingly, it is goal of the present invention to provide a tennis skirt having tacked down knife edge pleats, with a pocket hidden within the upper tacked down portion of the pleat.

It is also an objective of the present invention to provide a step-by-step method of manufacturing a tennis skirt having tacked down knife edge pleats, with a hidden pocket in the upper tacked down portion of the pleat.

SUMMARY OF THE INVENTION

These and other goals and objectives are achieved by the present invention, which provides a tennis skirt having a hidden pocket within a partially tacked down, knife edge tennis skirt that has the same attractive look and forgiving nature as the "Bonnie" tennis skirt. Specifically, the pocket is hidden within the upper, tacked portion of the pleat. Due to the unique manufacturing process of the present invention, the resulting tennis skirt is made to provide a hidden pocket which is rugged in construction and can attractively house tennis balls, keys and other items, without detracting from the continuous cascading pleated look of the tennis skirt.

A process for fabricating a garment having a pocket concealed by a pleat, includes the following steps:

Step 1—Cut Pocket and Panels of a Garment.
Step 2—Create Knife-Edge Pleat on Top of the Garment.
Step 3—Basting the Pleats on the Bottom of the Panels.
Step 4—Pressing the Pleats.
Step 5—Top Stitching the Pleats.
Step 6—Fusing a Pocket Welt to one Panel.
Step 7—Creasing the Pocket Welt.
Step 8—Joining and Securing the Pocket to the first Panel Adjacent the Welt.
Step 9—Top Stitch the Pocket Welt.
Step 10—Hanging the Pocket on the First Panel and Notching the Pocket.

Step 11—Inside Raise Stitching the Pocket.
Step 12—Tacking the Pocket to the Garment.
Step 13—Attaching the First and Second Panels Forming a Split Seam at the Pocket.
Step 14—Raise Stitch Inside of the Pocket to the Second Panel.
Step 15—Hang Pocket to Top of the Garment.
Step 16—Closing a Bottom Section of the Pocket Welt.
Step 17—Fusing the Second Panel.
Step 18—Attaching a Bartack to the Bottom of the Pocket Welt.
Step 19—Finishing the Skirt.

For a better understanding of the present invention reference is made to the following description, taken together with the figures, the scope of which is pointed out in the appended claims.

DETAILED DESCRIPTION OF THE INVENTION

In accordance with the present invention a pleated tennis skirt is provided having a pocket hidden beneath a partially tacked down, knife edge pleat. The tennis skirt of the present invention has the same attractive look and forgiving nature as the "Bonnie" tennis skirt. The pocket is hidden within the upper, tacked portion of the pleat. Due to the unique manufacturing process of the present invention, the resulting tennis skirt is manufactured to provide a hidden pocket which is rugged in construction and can attractively house tennis balls, keys and other items, without detracting from the continuous cascading pleated look of the tennis skirt.

Figure 1:
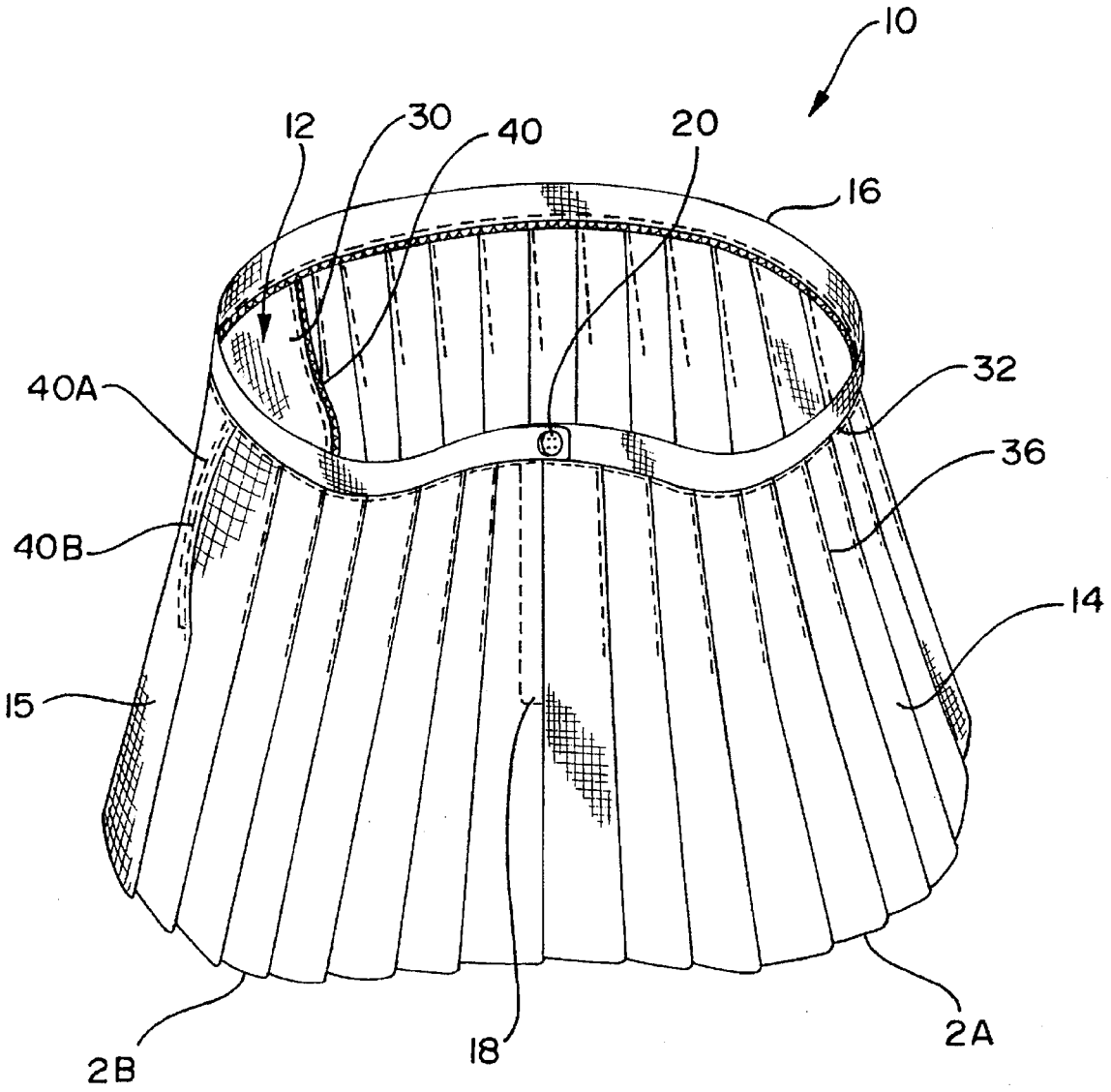
FIG. 1 is a top perspective view of one form of the tennis skirt formed in accordance with the present invention.
Figure 4:
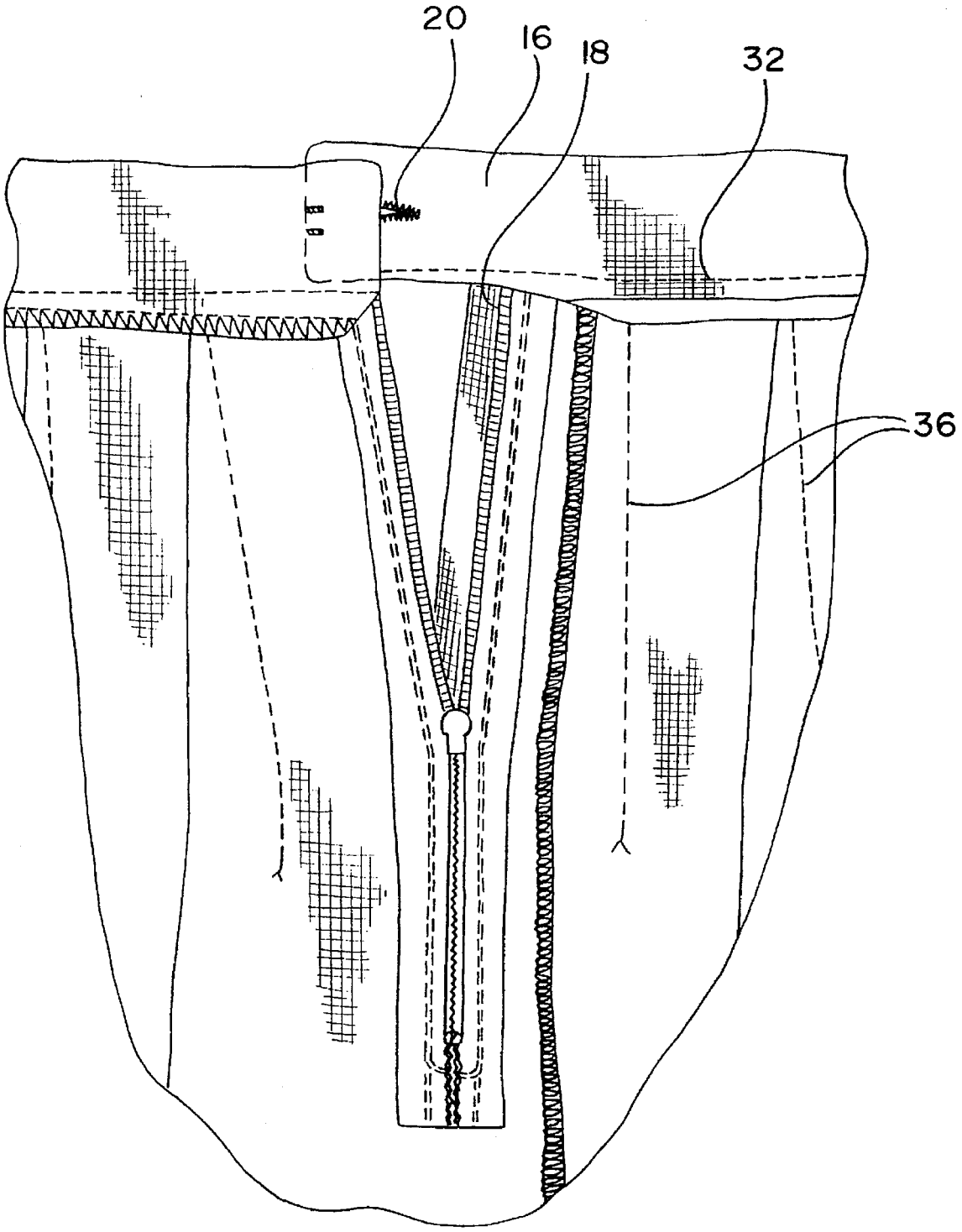
FIG. 4 is an interior rear elevation view of the zipper and button closure of the tennis skirt formed in accordance with the present invention.

Specifically as shown in the drawings, the pleated tennis skirt 10 of the present invention is illustrated in FIG. 1. The skirt 10 has a pocket 12 which is hidden behind the upper tacked or sewn down portion of the pleat 15. The pocket 12 is hidden from view when the skirt is worn, but allows sufficient room for placement of tennis balls, keys or other objects within the pocket 12. Since the pocket 12 drops below the level at which the pleats 14 are tacked, there is sufficient room for the pocket to be filled at its bottom without detracting from the continuous flowing look of the knife-pleated skirt. The tennis skirt 10, as shown from the exterior in FIG. 1 and from the interior in FIG. 4, has a waistband 16 at its top and is typically closed with a zipper 18 and button closure 20.

The present invention also provides a multi-step method for manufacturing a pleated garment, specifically a tennis skirt 10 of the present invention having a pocket hidden within the upper tacked down portion of the pleat. This step-by-step method will now be described in detail.

Step 1—Cut Pocket and Garment

Figure 2:
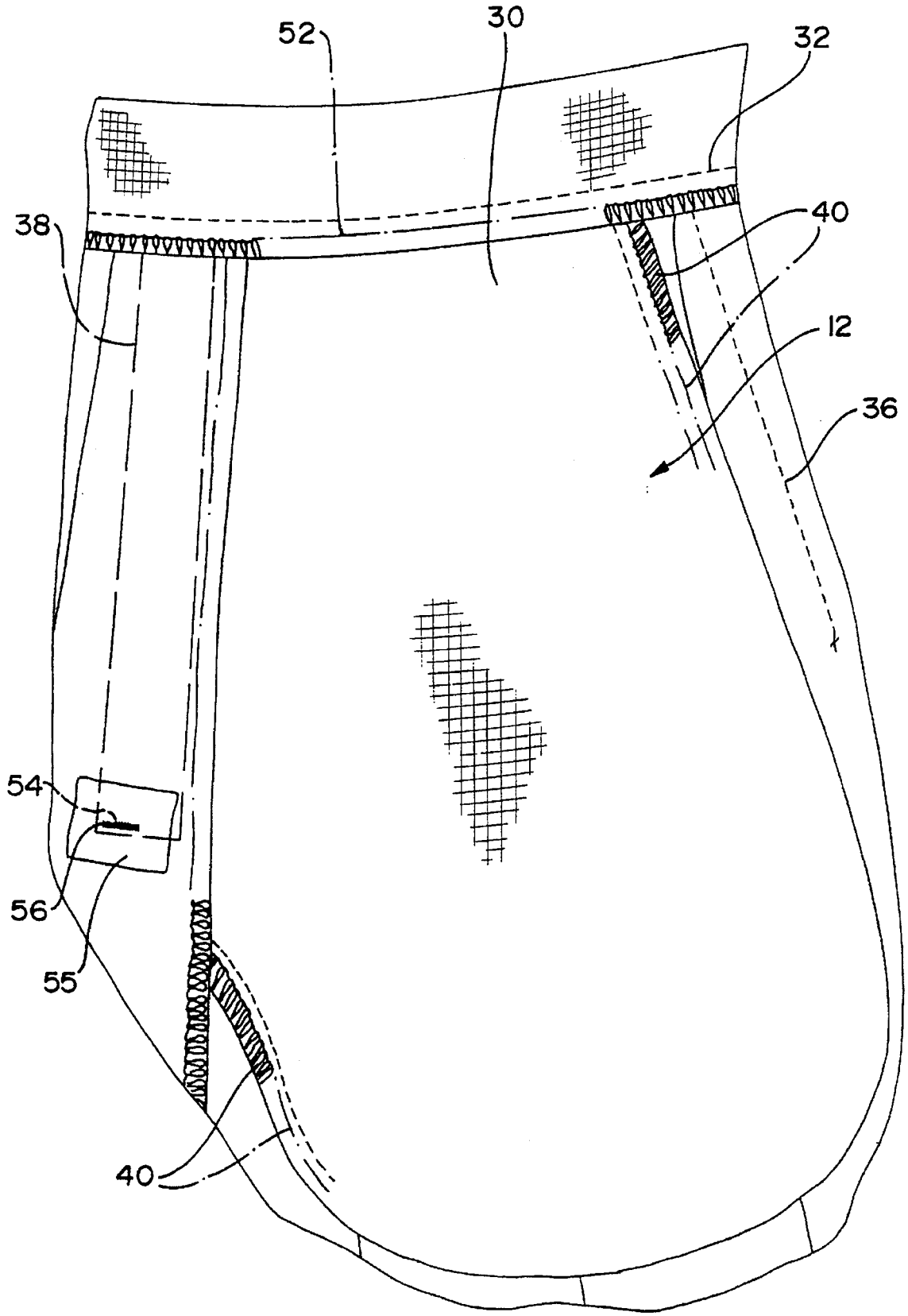
FIG. 2 is an interior front elevation view of one form of the pocket of the tennis skirt formed in accordance with the present invention.

The tennis skirt 10 is made in three parts. These include a first, preferably left panel 2A and a second or right panel 2B. These panels are cut utilizing a cutting machine, preferably with a vertical cutting blade in accordance with a pattern for a pleated tennis skirt, as is well-known to those skilled in the art. The skirt includes upper notches and lower notches, respectively, corresponding to the position of each knife edge pleat, including the knife edge that covers the pocket 12. The first panel 2A includes an approximately right angled cutout which will be folded back for attachment of a zipper on the rear portion of the tennis skirt 10. The pocket will be concealed behind the last pleat 15 on the opposite side from the right angled cutout, and hidden behind the last pleat 15. The third part makes up the pocket 12, which is preferably constructed from two panels 30, as illustrated in FIG. 2.

The fabric utilized for manufacturing the tennis skirt 10 of the present invention is preferably woven fabric which can stretch at least in the horizontal direction. This provides a stretch quality to the pleated skirt, and cooperates with the construction of the pleats to make the garment forgiving during movement, while playing tennis, and allows for natural weight gain and loss over the time that the skirt is being worn. A preferred fabric for use in the present invention is manufactured by Burlington Klopman Fabrics, a Division of Burlington Industries Inc. located in Hurt, Va. The preferred fabric is a 100% polyester weave sold under the style name ZEPHYR No. 097716. Those of ordinary skill in the art, however, know that other fabrics can be used with varying degrees of success depending on their weight and stretchability, for constructing the tennis skirt in accordance with the present invention.

Step 2—Create Knife Edge Pleats on Top of Garment

The panels are preferably folded manually so that the pleats are formed and aligned with the upper notches and lower notches, respectively. Each of the pleats 14 are formed facing towards one side of the garment. As illustrated in FIG. 1, the pleats are folded so that the knife edge faces towards the right. The pleats 14 are secured at the top of the panels by sewing, preferably with a single needle locks-stitch machine that provides stitching 32 across the top of each panel 2A and 2B, respectively.

Step 3—Basting the Pleats on the Bottom of the Panels

The pleats 14 are folded so that the panels 2A and 2B become narrower near the top and wider near the bottom. The pleats 14 are folded so that each knife edge aligns with the lower notches to form a series of continuous knife edge pleats 14. The pleats are temporarily secured at the bottom of each panel 2A and 2B, respectively, by basting, preferably by the use of a basting machine.

Step 4—Pressing the Pleats

The pleats 14 are pressed from the top to the bottom of each panel, preferably utilizing an electric hand iron with low pressure steam and vacuum in order to form the knife edge panel of each pleat 14.

Step 5—Top Stitching of the Pleats

Each of the pleats 14 is top stitched from the top down, as illustrated in FIG. 1, approximately one-third the height of the panel to tack down and secure the pleats at their upper edges. This process forms the unique flaring of the pleated tennis skirt 10. The top stitching 36 is preferably accomplished utilizing a single needle lock-stitch machine.

Step 6—Fusing the Pocket Welt

Figure 3:
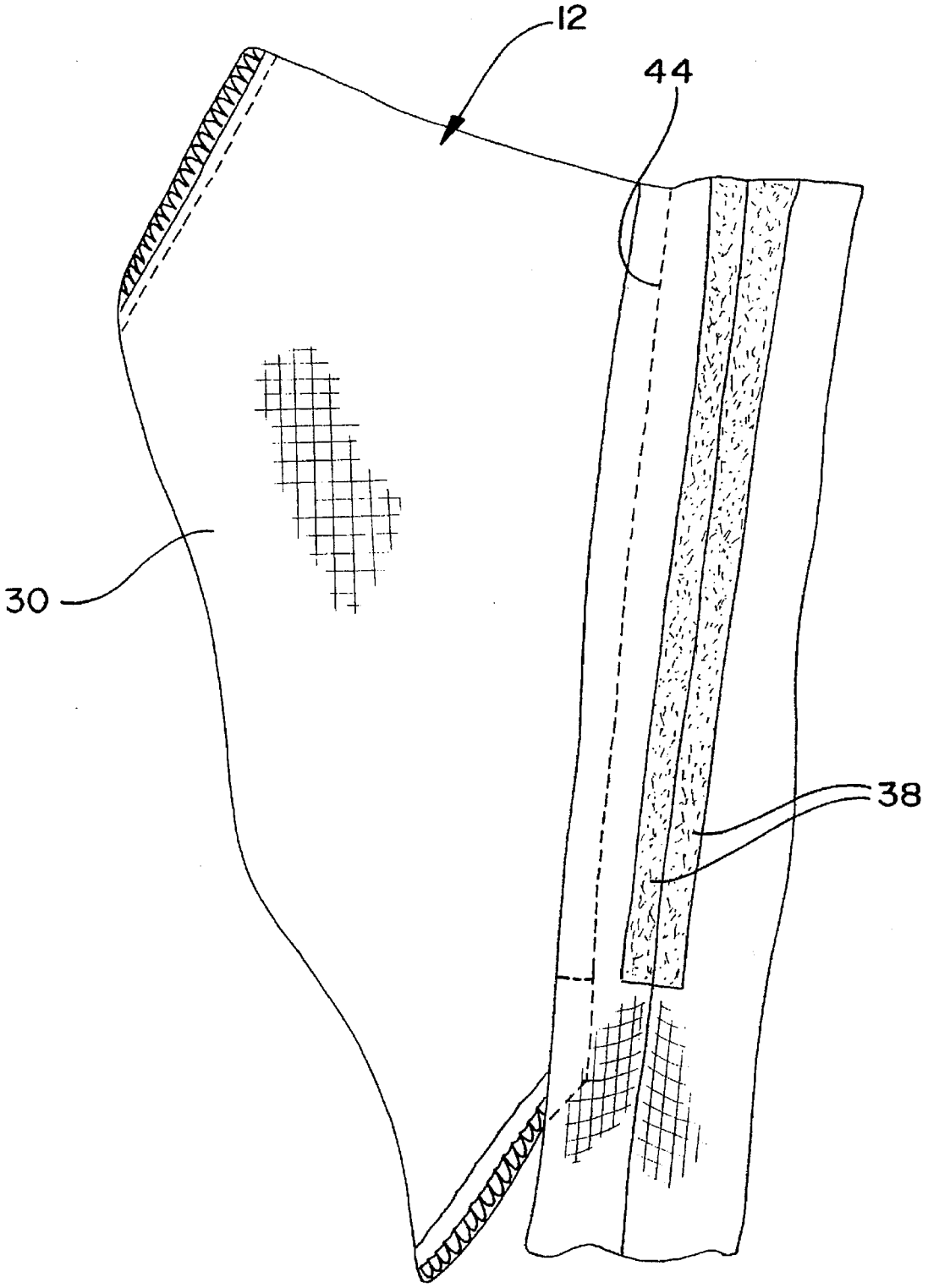
FIG. 3 is a partial interior rear elevation view of the pocket, shown in FIG. 2, folded back to facilitate viewing of the opposite side of said pocket.

A fusible fabric panel 38 is set approximately ¾ inch from the edge of the first panel 2A opposite the right angled cutout, as illustrated in FIG. 3. The fusible fabric 38 is used to create a pocket welt next to a split seam formed by the joining of the panels 2A, and 2B and pocket 12, respectively. The fusible fabric 38 is preferably approximately 1½ inches wide and approximately 7½ inches long and is used to reinforce the opening for the pocket. The fusible fabric panel 38 is preferably attached to the first panel 2A utilizing a heat activated adhesive, preferably by pressing the fusible fabric 38 to the garment with an electric hand iron with low pressure steam and vacuum, so that it becomes an integral part of the first panel 2A. The fusible fabric panel 38 is centered about the outer upper notch at the upper portion of the first panel 2A to reinforce the upper portion of the pleat 15 which covers the concealed pocket 12.

Step 7—Creasing the Pocket Welt

The first panel 2A is folded between the upper and lower notches creating a seam across the fused fabric panel 38, approximately 1½ inches from the split seam edge of first panel 2A. The panel 2A is pressed, preferably using an electric hand iron with low pressure steam and a vacuum to maintain the preferred 1½ inch knife edge crease from the top to the bottom of the panel. The fused fabric 38 can be seen through the fabric at this step but is located on the interior of panel 2A.

Step 8—Joining and Securing the Pocket

Figure 5:
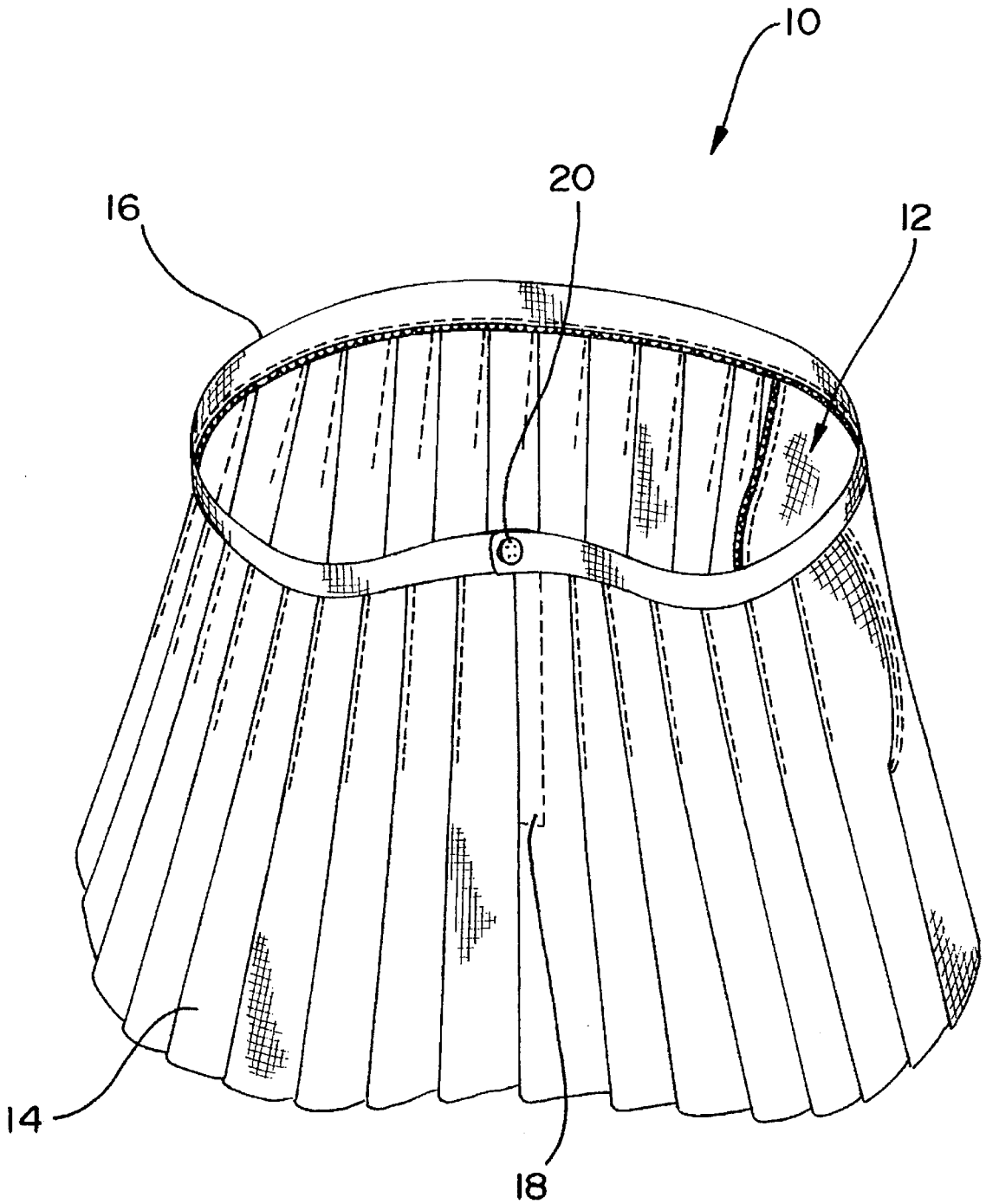
FIG. 5 is a top perspective view of another form of the tennis skirt formed in accordance with the present invention.
Figure 6:
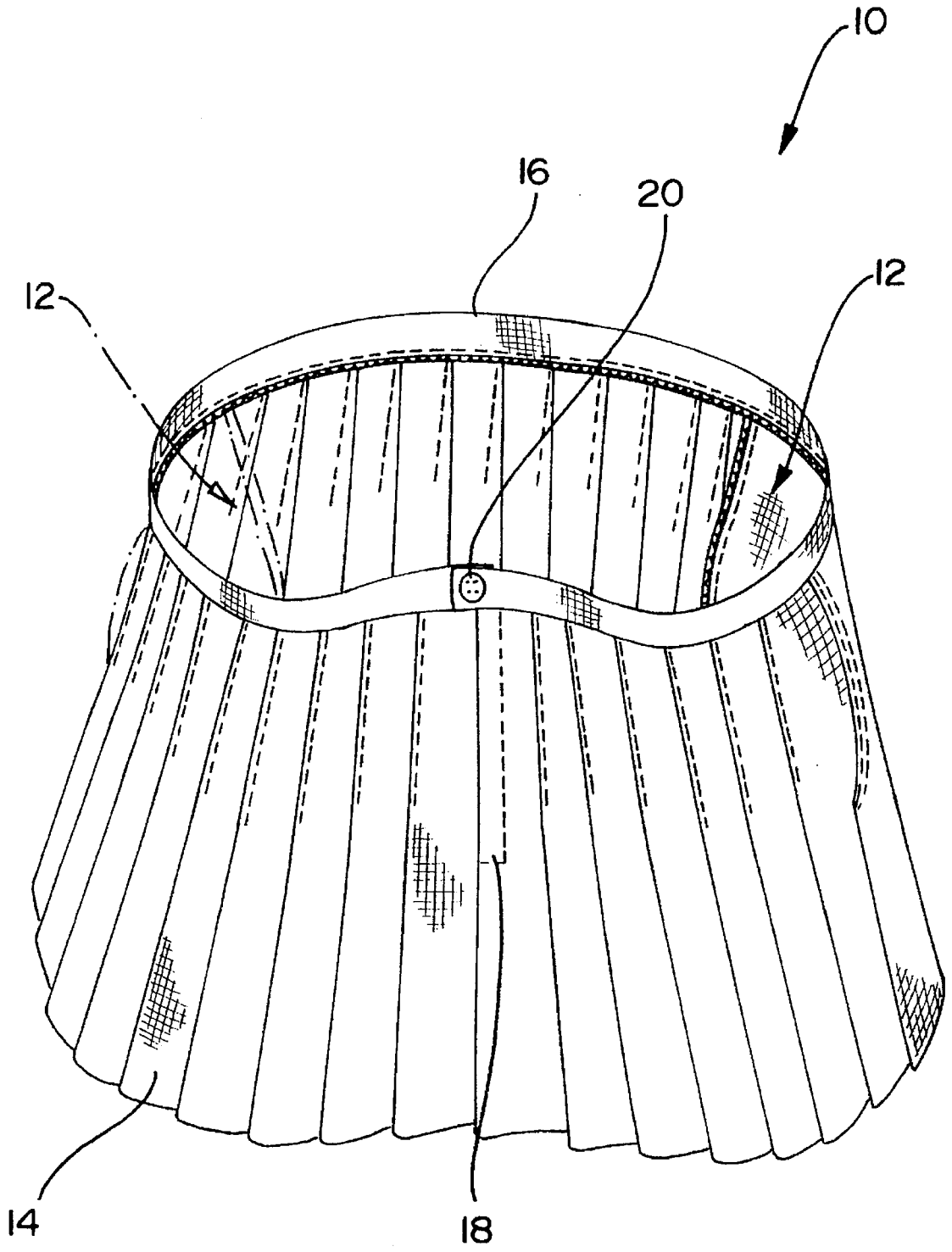
FIG. 6 is a top perspective view of yet another form of the tennis skirt formed in accordance with the present invention.

The pocket 12, illustrated in FIGS. 2 and 3, is preferably created by sewing front and rear panels 30 together. The two panels 30 of the pocket 12 are preferably joined with a safety stitch 40, as shown in FIG. 2, around the closed portion of the pocket 12. It is preferred that the upper portion and opening for the pocket 12 are not sewn together at this stage. In the present invention, the pocket is preferably rounded to accommodate tennis balls and other objects, for placement below the level of the opening, and the pocket is preferably oversized for accommodating such items. The bottom portion or the pocket 12 is made so that it settles below the level of the top stitching 36 of the pleats 14 so that any items within the pocket can be accommodated by the expansion of the pocket and the lower open portions of the pleats 14 which have not been tacked down. Although one pocket is illustrated in manufacturing the present invention, more than one pocket can be added in the present invention on either side of the garment and preferably sewn in the direction of the knife edge of the pleat. Also, as shown in FIG. 5, the pleats 14 can be formed with the knife edge on their left and the pocket placed on the right side of the skirt for a left-handed player. Alternatively, as shown in FIG. 6, two or more pockets 12 can be placed within the pleated skirt.

Step 9—Top Stitch Welt of Pocket

The pocket welt is top stitched approximately ⅓ of the way down, or 6½ inches down from the top of panel 2A on the precreased and fused panel approximately 1/16 of an inch from the edge of the crease covering the reinforced pocket welt. Preferably, as shown in FIG. 1, a double top stitch is used to create outer stitch 40B and inner stitch 40A. The stitching is accomplished utilizing a single or preferably a double needle lock-stitch sewing machine. The purpose of the stitching 40A and 40B is to create a slightly thicker and reinforced edge at the opening of pocket 12 for the player's hand.

Step 10—Hanging and Notching the Pocket

Pocket 12 is hung at one edge of its opening onto the exterior of panel 2A at the edge adjacent to the pocket welt 38, as shown in FIG. 3. A notch is cut in panel 2A and in the attached edge of pocket 12 immediately below the level of stitching 44 which holds one side of the pocket 12 to panel 2A. The pocket 12 is hung to panel 2A preferably utilizing a single needle lock-stitch sewing machine.

Step 11—Interior Raise Stitching of the Pocket

The portion of the pocket 12 attached to panel 2A is sewn utilizing a raise stitch where it is hung to panel 2A. The purpose of the raise stitch is to turn the seam so that the attached portion of the pocket 12 lies flat against the interior of panel 2A. The raised stitch is preferably sewn utilizing a single needle lock-stitch machine. The notch created in step 10 allows sewing of the interior raised stitch.

Step 12—Tacking Pocket to Garment

The bottom of pocket 12 is tacked, preferably using a single needle lock-stitch machine to first panel 2A above the notch created in step 10. The notch allows turning of the bottom of the pocket for sewing the tacking connecting pocket 12 to panel 2A.

Step 13—Attaching the Panels at the Split Seam

Panels 2A and 2B are joined at a split seam which is formed at the junction of the two panels. The panels 2A and 2B are placed so that their exterior portions are facing each other and are sewn from the bottom of each of the panels until pocket notch has been reached utilizing a triple needle over-lock machine. Then, the upper portion of panel 2B is joined to the unattached side of pocket 12 by sewing to the top of panel 2B to form one continuous garment 10.

Step 14—Raise Stitching Interior of Pocket

Raise stitching the interior of pocket 12 and second panel 2B utilizing a single needle lock-stitch machine as described in Step 11. This raise stitch turns the second pocket seam so that the pocket 12 lies flat against the first panel 2A.

Step 15—Hang Pocket to Top of Garment

The pocket 12 is hung to the top of garment 10 by sewing the upper edge of the pocket against the top of first panel 2A utilizing a single needle lock-stitch machine. This creates a stitch 52, as shown in FIG. 2, ¼ inch from the top edge of the interior of first panel 2A. To accomplish this step the garment is folded to flatten pocket 12 against first panel 2A and align the pocket seam, then the pocket is sewn at its upper edge.

Step 16—Closing Bottom of Pocket Welt

A tack 54, with its general location pointed to in FIG. 2, is sewn to the bottom of the pocket welt 38, attaching the pocket welt, the bottom of pocket 12 and panel 2B at 54, utilizing a single needle lock-stitch machine.

Step 17—Fusing the Left Panel

A small piece of fusible fabric 55, as shown in FIG. 2, preferably about 1 inch square, is placed at the base of second panel 2B at the bottom of the pocket, where it ends, centered about the tack 54. The fusible fabric 55 is preferably heat activated and is pressed using an electric hand iron with low pressure steam and vacuum so that it becomes integral with second panel 2B. The fusible fabric reinforces the bottom of the pocket tack 54 to allow it to withstand additional stress during use and to provide a platform for a bartack.

Step 18—Bartack Bottom of Pocket Welt

The bottom of the pocket welt is bartacked, preferably utilizing 42-stitch bartack machine across the tack 54 sewn in step 16. Bartack 56 is illustrated in FIG. 2 and extends through each of first panel 2A, pocket 12, second panel 2B, tack 54 and fused fabric 55 to further reinforce the opening of pocket 12.

Step 19—Finishing the Skirt

The skirt is finished, in the manner that is well-known to those of ordinary skill in the art by attaching two ends of panels 2A and 2B, respectively, and inserting a zipper 18, a top band 16, and button closure 20. The skirt is then pressed and hemmed at the bottom as shown in FIG. 1.

Thus, while I have described what are the presently contemplated preferred embodiments of the present invention, further changes and modifications could be made by those of ordinary skill in the art without departing from the scope of the invention, and it is contemplated to claim all such changes and modifications.

I claim:

1. A pleated tennis skirt having a pocket concealed by a pleat, comprising a pocket hidden beneath a pleat and the structure of the pleat having partially tacked down, knife edge portion and said pleat having an upper tacked down portion and a loose open portion which extends to the bottom of the tennis skirt, the opening of the pocket extending from an upper band to at least a lower edge of the tacked down portion of the pleat, wherein said pleat and said pocket being displaced at least one pleat width away from a vertical opening in said tennis skirt.

2. The tennis skirt as recited in claim 1, further comprising a bartack reinforcing the bottom of the opening of said pocket.

3. The tennis skirt as recited in claim 1, wherein said pocket is attached flush against an inner surface of said tennis skirt.

4. The tennis skirt as recited in claim 3, wherein the opening of said pocket is reinforced at a pleat covering said opening.

5. The tennis skirt as recited in claim 4, wherein said tacked down portion of the pleat covering the opening of said pocket is reinforced by a bartack.

6. The tennis skirt as recited in claim 1, wherein said knife edge pleats and said opening for said pocket face torwards the right and said pocket is on a left hand side of said tennis skirt.

7. The tennis skirt as recited in claim 1, wherein said knife edge pleats and said opening for said pocket face towards the left and said pocket is on a right hand side of said tennis skirt.

8. The tennis skirt as recited in claim 1, wherein said skirt has more than one pocket hidden by said knife edge pleats.

9. The tennis skirt as recited in claim 1, wherein said knife edge pleats extend completely around an entire circumference of said tennis skirt.

* * * * *